US006224198B1

(12) United States Patent
Cook et al.

(10) Patent No.: US 6,224,198 B1
(45) Date of Patent: May 1, 2001

(54) METHOD AND APPARATUS FOR REFILLING INK JET CARTRIDGES WITH MINIMUM INK LOSS

(75) Inventors: William Paul Cook; Gary Allen Denton, both of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/291,244

(22) Filed: Apr. 13, 1999

(51) Int. Cl.[7] ..... B41F 2/175
(52) U.S. Cl. ..... 347/85
(58) Field of Search ..... 347/84, 85, 86, 347/87, 35, 89; 141/4, 5, 94, 95

(56) References Cited

U.S. PATENT DOCUMENTS

| | | | | |
|---|---|---|---|---|
| 4,432,005 | | 2/1984 | Duffield et al. | 347/86 |
| 4,437,104 | | 3/1984 | Hudson | 347/86 |
| 4,558,326 | * | 12/1985 | Kimura et al. | 347/30 |
| 4,610,202 | | 9/1986 | Ebinuma et al. | 101/364 |
| 4,631,556 | | 12/1986 | Watanabe et al. | 347/30 |
| 4,636,814 | | 1/1987 | Terasawa | 347/86 |
| 4,702,287 | * | 10/1987 | Higie et al. | 141/4 |
| 4,967,207 | * | 10/1990 | Ruder | 347/7 |
| 4,968,998 | * | 11/1990 | Allen | 347/7 |
| 5,136,305 | * | 8/1992 | Ims | 347/7 |
| 5,282,495 | * | 2/1994 | Chamberlain | 141/4 |
| 5,369,429 | * | 11/1994 | Erickson | 347/7 |
| 5,504,510 | | 4/1996 | Miyakawa | 347/85 |
| 5,944,066 | * | 8/1999 | Viard | 141/1 |

FOREIGN PATENT DOCUMENTS 5-318760 * 12/1993 (JP) .

* cited by examiner

*Primary Examiner*—N. Le
*Assistant Examiner*—Michael Nghiem
(74) *Attorney, Agent, or Firm*—B. Franklin Griffin, Jr.

(57) ABSTRACT

A system for intermittently refilling the cartridge reservoir in an ink jet printer from an off-board ink supply tests the ink flow path prior to initiating a refill operation. Air at a pressure greater than the ink feed pressure is applied to the ink flow path to check the integrity of the system. After venting the system to the atmosphere, a slow leak check is made by closing the system, pressurizing it at the feed pressure, turning off the pressure source and, after a short interval, checking the pressure to see if the feed pressure is being maintained. If the integrity check or the slow leak test should fail, the refill operation is aborted and an indicator is set to alert an operator that intervention is required. During the interval the system is being raised from atmospheric to feed pressure, the air displacement is measured and saved as an indication of whether the amount of ink in the off-board supply exceeds a given level. As ink is being transferred into the reservoir, the ink level in the reservoir is monitored. When the ink level does not rise, or rises too slowly, the saved air displacement is used to determine whether to abort the refill operation and indicate a system problem, or set an indicator to signal that the off-board ink supply is exhausted. A controller measures the air displacement by measuring the time, or counting the number of pump strokes, required to raise the system pressure from atmospheric to feed pressure.

31 Claims, 3 Drawing Sheets

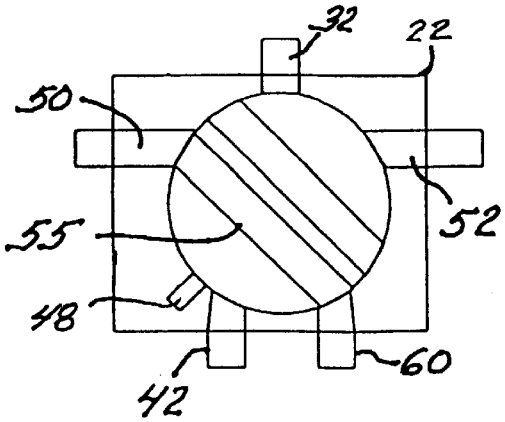
FIG. 4A
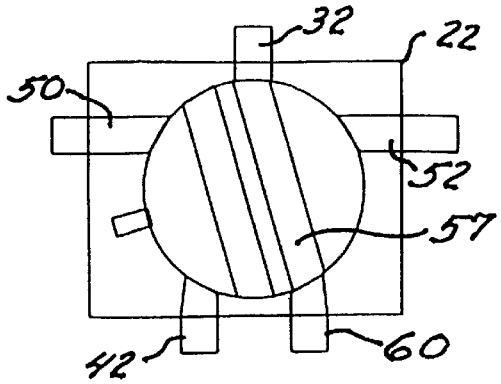
Fig. 4B
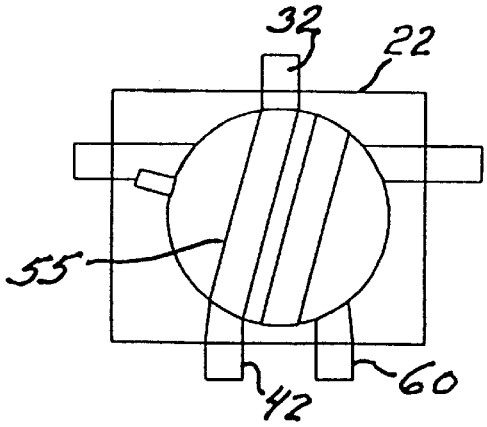
Fig. 4C
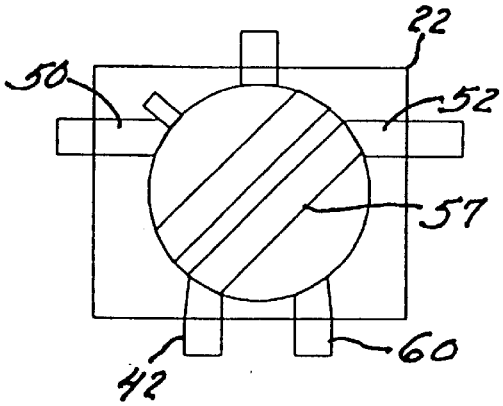
Fig. 4D
FIG. 5A
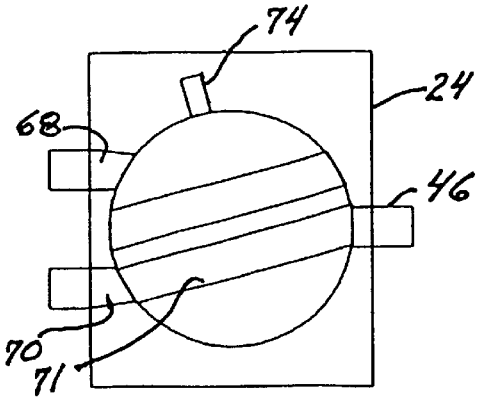
FIG. 5B
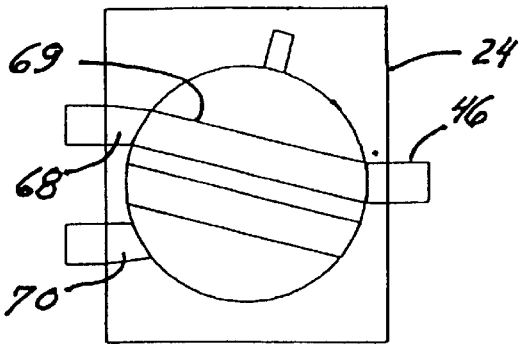

METHOD AND APPARATUS FOR REFILLING INK JET CARTRIDGES WITH MINIMUM INK LOSS

FIELD OF THE INVENTION

This invention relates to a method and apparatus for refilling disposable ink cartridges of ink jet printheads from ink reservoirs located off-board the printhead carriages. The pressure in ink lines connecting the off board reservoirs to the cartridges is monitored prior to and during a refill operation so that refilling is prohibited or stopped if an ink line is open to atmospheric pressure.

BACKGROUND OF THE INVENTION

To reduce printhead carriage mass so as to obtain high carriage accelerations and velocities, ink jet printers are provided with ink reservoirs located off-board the carriages, ink in these reservoirs being used to replenish ink drawn from the printhead cartridge reservoirs during printing. The refill may take place continuously or intermittently. For continuous refilling, the off-board reservoirs may be connected via hoses to the printhead cartridges as shown for example in U.S. Pat. No. 5,369,429. For intermittent refilling as shown in U.S. Pat. Nos. 5,136,305, 4,967,207 and 4,968,998, the printheads are moved to a refill station where the printhead cartridges are refilled with ink from the off-board reservoirs.

Ink leakage is a particular concern in network printers using the intermittent type refill system. Such printers are frequently left running unattended for extended periods of time and, generally speaking, have larger off-board ink reservoirs. Therefore, the potential for catastrophic ink spillage exists if a leak should occur during a period when the printer is running unattended.

SUMMARY OF THE INVENTION

An object of the present invention is to provide a refill system for intermittently refilling a cartridge reservoir of an ink jet printer from an off-board ink supply, the system providing checks for catastrophic and slow leaks prior to initiating each refill operation.

Another object of the invention is to provide a refill system for intermittently refilling the cartridge reservoir of an ink jet printer from an off-board ink supply via an ink flow path, the refill system being characterized in that the ink flow path is monitored for leaks both before and during each refill operation.

A further object of the invention is to provide a refill system for intermittently refilling the cartridge reservoir of an ink jet printer from an off-board ink supply via an ink flow path, the system being characterized in that, after each refill operation, ink is purged from the ink flow path and the path is vented to the atmosphere.

According to the invention, a refill system for intermittently refilling the cartridge reservoir of an ink jet printer from an off-board ink supply comprises an ink flow path connected to the ink supply for dispensing ink into the cartridge reservoir; a pressure detector; an air pump; a pressure control valve for selectively connecting the ink flow path and the ink supply to the air pump; a controller responsive to the pressure detector for controlling the pump and the pressure control valve to apply air at a test pressure from the pump to the ink flow path to check for leaks in the ink flow path, and apply air at an ink feed pressure from the pump to the ink supply to feed ink from the ink supply through the ink flow path to the cartridge reservoir. A dispensing valve blocks the ink flow path during the interval the test pressure is being applied and vents the ink flow path to the atmosphere after a refill operation is completed. The control valve is a multiport valve having positions for connecting the ink flow path to the atmosphere or to the pump, and positions for applying atmospheric pressure or pressure from the pump to the off-board ink supply.

In accordance with one aspect of the invention, the air displacement required to raise the pressure in the ink flow path from atmospheric pressure to the ink flow pressure is measured and utilized as an indication of the volume of ink in the off-board ink supply prior to initiating an ink transfer.

In accordance with a further aspect of the invention, an ink level sensor is provided in the cartridge reservoir for sensing the level of ink therein. During a refill operation the controller monitors the ink level sensor to determine if the ink level is continuously rising. If the ink level is not continuously rising, the refill operation is terminated and an indicator is set. In an alternative embodiment, one of two indicators may be set depending on the saved indication of the volume of ink in the off-board ink supply prior to initiating the ink transfer.

Other objects and advantages of the invention will become obvious upon consideration of the following description and the accompanying drawings.

BRIEF DESCRIPTION OF THE DRAWINGS

FIGS. 4A–4D illustrate four positions of a control valve used to control pressure in the system; and, FIGS. 5A and 5B illustrate a dispensing valve in a dispensing position (FIG. 5A) and a venting position (FIG. 5B).

DESCRIPTION OF PREFERRED EMBODIMENTS

Figure 1:
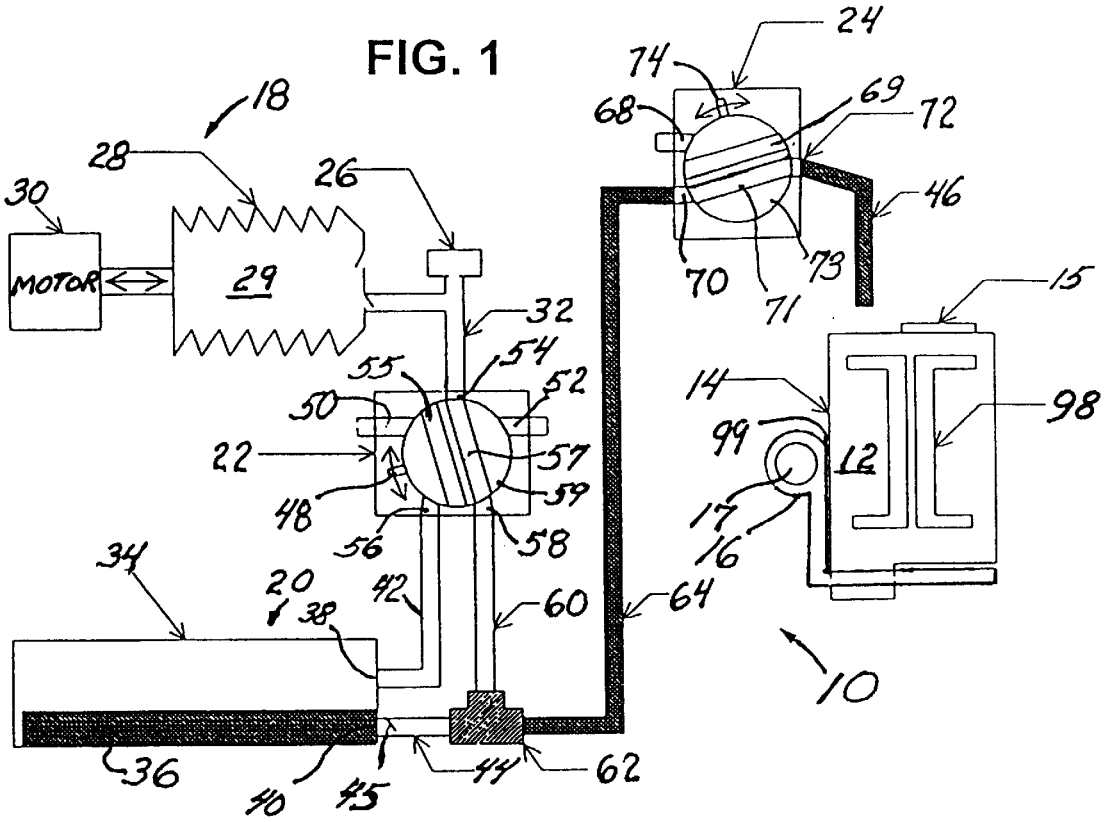
FIG. 1 schematically illustrates an ink supply system according to the invention.

FIG. 1 illustrates an ink supply system 10 for replenishing the ink supply in a single, preferably foam-filled, ink reservoir 12 of a printhead cartridge 14. The cartridge 14 is conventional and is mounted in a conventional manner on a printhead carriage 16 slidable back and forth on a support shaft 17 so that the cartridge may be moved back and forth during printing or moved to a refill station (not shown) when the supply of ink in reservoir 12 must be replenished.

Ink supply system 10 comprises a pump or pressure source 18, an off-board ink reservoir 20, a pressure control valve 22, a dispensing valve 24 and a pressure sensor 26. Pressure source 18 may, for example, comprise a pump or bellows 28 and an electric drive motor 30 for alternately expanding and contracting the bellows, but other pressure sources may be used provided they may be controlled as subsequently described to vary the pressure in an air line 32 connected to the chamber 29 of the bellows.

The off-board reservoir 20 may also be of conventional design but preferably comprises an air-tight rigid hollow shell 34 having therein a bladder or sac 36 filled with ink. The shell is provided with first and second openings 38,40 which are sealed by elastic barriers that are pierceable by hollow needles (not shown). One needle connects with an air line 42 and the other needle connects with an ink flow path, comprising lines 44 and 64, through a check valve 45. When cartridge reservoir 12 requires refilling, a positive pressure is applied via line 42 to the interior region of shell 34 between the shell and bladder 36 so that ink is forced out of the bladder through check valve 45 and through the ink flow path 44,64.

The control valve 22 is preferably a multi-port ball valve having input ports 50 and 52 vented to atmosphere, an input port 54 connected to the air line 32, and first and second output ports 56 and 58. Output port 56 is connected via the air line 42 to the region between the shell 34 and bladder 36. Output port 58 is connected via an air/ink line 60 to a T-connector 62 having arms connecting the ink output line 44 of the ink reservoir 20 to an ink line 64 which conveys ink from the reservoir to an input port 70 of dispensing valve 24. Because the greatest exposure to ink loss is through lines 44, 60 and 62 in the region near T-connector 62, the sections of these lines which are below the top of reservoir 20 are strengthened to increase leak resistance.

Valve 22 has a handle 48 that is driven or stepped between four positions by electro mechanical or other drive means so as to connect the input ports of the valve to its output ports via two air passages 55, 57 in ball 59. The connections may be made in any one of four configurations as shown in FIGS. 4A–4D. Handle 48 is biased so that when it is not driven, valve 22 returns to the state shown in FIG. 4D. By way of example only, handle 48 may be driven by a spring biased rotary stepper motor.

Valve 24 is a ball valve having a handle 74 that is driven or stepped between two positions (FIGS. 5A and 5B) by electro-mechanical or other drive means so as to selectively connect one of the valve input ports 68 or 70 to the output port 72 via one of two passages 69,71 in ball 73. Input port 68 is vented to atmosphere and input port 70 is connected to the reservoir 20 via ink lines 64 and 44. The ink line dispensing segment 46 is connected to the output port 72. Handle 74 is biased so that when the handle is not driven, the dispensing line 46 is connected to atmosphere via passage 69 and input port 68 as shown in (FIG. 5B).

Figure 2:
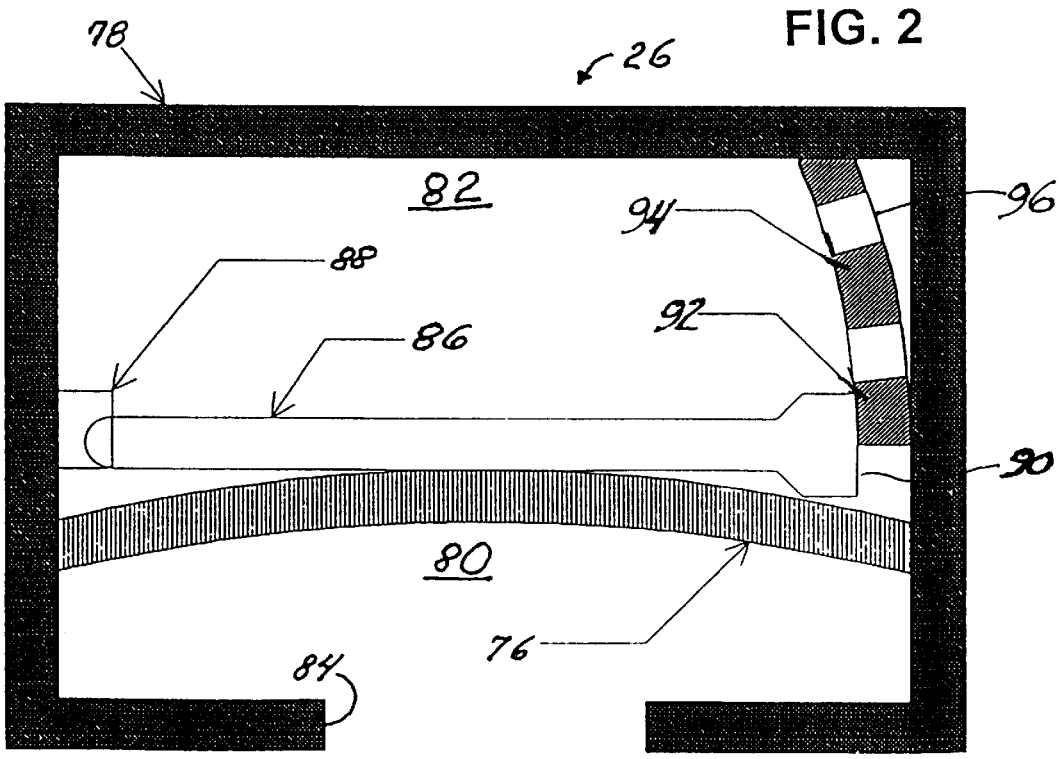
FIG. 2 is a sectional view of a pressure sensor suitable for use in the ink supply system.

Pressure sensor 26 is provided to sense the pressure in air line 32. As illustrated in FIG. 2, the pressure sensor 26 is a low-cost digital sensor including a flexible membrane 76 which divides the interior of a housing 78 into first and second chambers 80 and 82. Chamber 80 connects with air line 32 via an opening 84 so that air pressure in line 32 acts against the membrane 76. A flexible electrical contact 86 is disposed within chamber 82 and connected at one end in cantilever fashion to an electrical terminal 88. The contact 86 engages the flexible membrane 76 so that as the pressure in line 32 varies the pressure in chamber 80 to move the membrane, the free end surface 90 of the contact wipes across a plurality of arcuately disposed stationary electrical contacts 92,94 held within a non-conductive stationary frame 96.

Membrane 76 is capable of moving contact 86 so that the contact end surface 90 may move over a range from below contact 92 to above contact 94. Pressure sensor 26, in combination with a microprocessor controller 100 (FIG. 3) monitors line 32 for three different pressures or, more accurately, three different pressure ranges. The first pressure is atmospheric pressure. When the pressure in line 32 and chamber 80 is at atmospheric pressure the surface 90 is below contact 92 so that there is no electrical connection through the sensor.

The second pressure range, referred to herein as the 'low' or ink feed pressure is on the order of 5 to 10 inches of water. The low pressure, when admitted to the reservoir 20 via valve 22 and line 42, is adequate to force ink at the desired rate from reservoir 20 to the cartridge 14 via valve 24. When the pressure in line 32 is in the 'low' pressure range, contact surface 90 ranges in position (moving counterclockwise) from just engaging the lower edge of contact 92 to a position just engaging the lower edge of contact 94.

The third pressure range, referred to herein as the 'high' or test pressure range, is on the order of two to three times the low pressure and is used to check the system for leaks. A pressure of this magnitude causes membrane 76 to move contact 86 counterclockwise from the low to the high pressure range. While in the 'high' pressure range, contact surface 90 ranges in position (moving counterclockwise from the 'low' position) from no longer engaging the upper edge of contact 92 to a position no longer engaging the upper edge of contact 94.

At pressures above the range of the high pressure, contact end surface 90 moves above contact 94 so that there is no electrical connection through the sensor.

The arcuate length of surface 90 is greater than the arcuate distance of frame 96 between contacts 92 and 94 so that the surface 90 may bridge or simultaneously engage both contacts. The purpose of this bridging is to allow the controller 100 to distinguish between, on one hand, a pressure between the high and low pressures, and on the other hand, atmospheric pressure or a pressure higher than the high pressure. Without bridging, all three conditions would result in the same output signal from the sensor.

By providing the contact bridging, only atmospheric pressure and a pressure higher than the high pressure result in the same output indication from the sensor, and the controller can determine which is the correct pressure by considering the previous pressure indication. Each time the controller 100 determines a pressure, it saves an indication of the pressure, and by comparing a previous indication with a current indication the controller can determine if the correct pressure is atmospheric or higher than the high pressure. For example, if the controller samples the sensor by applying a signal to terminal 88, and no output signal is produced at either contact 92 or 94, the pressure may be either atmospheric or higher than the high pressure. The previous saved indication is examined and if it indicated a high pressure then the current pressure must be higher than the high pressure, but if the saved indication indicated a low pressure then the current pressure must be atmospheric pressure.

The printhead cartridge 14 has therein an ink level sensor 98. Sensor 98 may be a variable sensor having a capacitance which varies according to the level of ink in the foam-filled ink reservoir 12. The controller 100 (FIG. 3) samples the sensor 98 on the order of every 100 ms and includes an analog-to-digital. converter 101 for digitizing the feedback signal from the sensor. The controller compares the digitized value with two reference values to determine when the reservoir 12 is 'empty', that is, when the ink level is so low that the reservoir should be refilled, or full. As subsequently explained, the feedback signal from sensor 98 is also monitored during intervals when ink should be flowing into the reservoir 12 and serves as a way for detecting when the off-board reservoir 20 is empty. Preferably, the sensor 98 is connected to controller 100 via contacts on a conventional flex circuit 99 so that the sensor feedback signal is lost if the cartridge 14 is removed from the carrier 16. This permits detection of the removal of the cartridge during a refill operation so that ink loss may be minimized by terminating the refill operation as later described.

Figure 3:
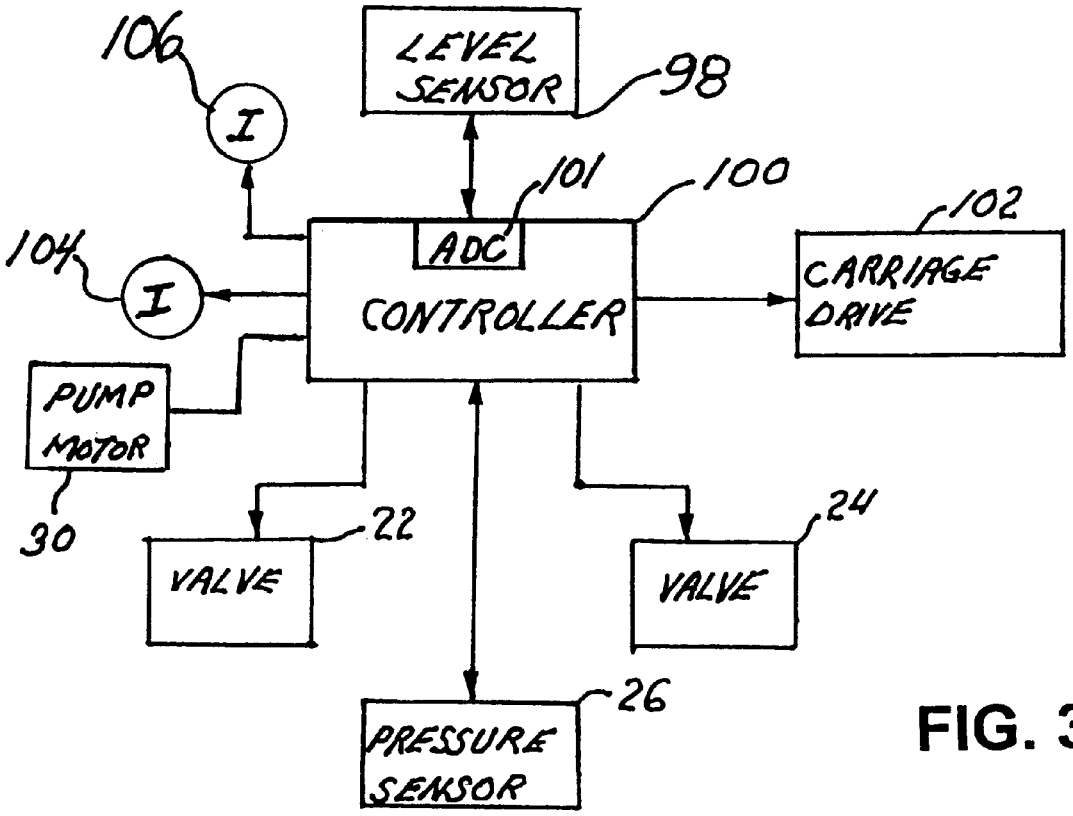
FIG. 3 is a block diagram illustrating electrical connections between components of the ink supply system.

As shown in FIG. 3, the cartridge ink level sensor 98, pressure sensor 26, the drive motors for valves 22 and 24, and bellows drive motor 30 are connected to the controller 100. The controller may be the microprocessor which controls operation of the printer and is of conventional design. Periodically, the controller samples the level sensor 98 in the printhead cartridge 14 and when the sensor indicates that the cartridge requires refilling, the controller controls a carriage drive mechanism 102 which moves carriage 16 and the cartridge to a refill station (not shown), slides open a sliding cover 15 on the cartridge, and establishes a connection between the dispensing line 46 and the reservoir 12, after which the controller initiates a refill operation. The drive mechanism and refill station are not shown but they may take any one of many forms known in the art. The cartridge, for example, may have an ink input opening closed by a valve as shown in the patents mentioned above, so that the sliding cover is not required.

A refill operation is initiated when controller 100 determines that the reservoir 12 is empty and the cartridge 14 is positioned at the refill station. Prior to initiation of a refill operation the system is in an initial or reset state wherein bellows drive motor 30 is off, the valve 22 is in the position shown in FIG. 4D so that line 42 is connected to the ambient atmosphere via passage 57 and the valve port 52, and dispensing valve 24 is in the position shown in FIG. 5B so that the dispensing line 46 is connected to ambient atmosphere via passage 69 and valve port 68. There is no ink in any of the lines or connections 32, 42, 44, 46, 60 and 64, except for possibly a small amount of ink in the region of the T-connection 62. The refill operation is carried out in five phases.

Phase I.

In phase I, the integrity of the system is checked to determine if there are any leaks in the ink lines 44 and 64 or their connections, or if there is no off-board supply of ink connected to the system. The controller 100 sets valve 22 to the position shown in FIG. 4B so that communication is established between line 32 and lines 60, 44 and 64. Next, the controller energizes motor 30 for a fixed interval of time or for a fixed number of strokes. Since valve 24 is still in the position shown in FIG. 5B, the downstream end of line 64 is blocked by the valve so that operation of bellows 28 builds up the pressure in lines 32, 60, 44 and 64. The check valve 45 prevents air from entering bladder 36 during this time.

The motor 30 is energized for an interval of time $T_1$, or for a fixed number of strokes of bellows 28 sufficient to raise the pressure in the lines to the high pressure. It is possible that the high pressure may be achieved even though there is a slow leak in the system. Therefore, after the interval $T_1$ has elapsed, the controller waits for a second interval $T_2$. At the end of interval $T_2$ the controller samples the output of pressure sensor 26 to determine if the high pressure is still being maintained in the lines.

The intervals $T_1$ and $T_2$ will vary depending on such factors as bellows volume and stroke length and the internal volume of the portion of the system being tested.

If the high pressure is not maintained until the end of interval $T_2$, there must be a leak in the system. The controller 100 terminates the refill operation and sets a visual or audible indicator 104 (FIG. 3) to signal that service intervention is required. On the other hand, if the system is still at the high pressure the controller advances to phase II of the refill operation.

Phase II.

This phase releases the high pressure used to test the integrity of the ink lines and their connections. The phase is initiated when the controller sets valve 22 to the position shown in FIG. 4A. This connects lines 60, 44 and 64 to atmosphere through passage 55 and valve port 55 thus releasing the high pressure in these lines. At the same time, air under the high pressure is trapped in line 32.

Next the controller moves valve 22 to the position shown in FIG. 4C thereby connecting the interior of shell 34 to line 32 via line 42 and passage 55 in the valve. This releases the air under high pressure trapped in line 32. Because the free air volume of shell 34 is much greater than the volume of line 32, the pressure in line 32 drops to some value which is insignificantly above atmospheric pressure.

Phase III.

This phase tests the ability of the system to maintain the low pressure level necessary for causing the feeding of ink from reservoir 20 to the dispensing line 46. Controller 100 energizes pump drive motor 30 and begins monitoring the pressure by sampling pressure sensor 26. The pump motor is energized for an interval of time $T_3$ or until the sensor indicates that the low pressure has been reached, whichever comes first. The air displacement (pump motor on time or number of pump strokes) required to reach the low pressure level is saved in a memory in controller 100 as an indication of the ink level in the off-board reservoir 20. If the minimum air displacement is required, the reservoir 20 is full but if the maximum air displacement is required the reservoir is empty or almost empty. A value somewhere between the maximum and minimum can be used to infer, by interpolation, the current ink level or capacity of the reservoir 20.

The controller 100 repetitively samples sensor 26 while the pump motor is energized. If the pressure in line 32 reaches the desired pressure within the interval $T_3$ then a check is made for a slow leak in the air line 42 and its connections. The energizing of the pump motor and the sampling of the pressure sensor are terminated either when the pressure in line 32 reaches the low pressure or when the interval $T_3$ has elapsed. Then, after an interval $T_4$ the pressure sensor is again sampled. If the line 32 is still at the low pressure, it means that there is no leak and phase IV of the refill operation is initiated.

If, at the end of interval $T_4$, the pressure in line 32 has dropped below the low level, it means that there is a leak in line 42 or its connections. The indicator 104 is energized to signal that operator intervention is required and the refill operation is aborted by jumping to Phase V described below.

If the pressure in line 32 never reaches the low pressure during the interval $T_3$, it probably means that reservoir 20 is not installed. The refill operation is aborted by jumping to Phase V and an indicator is energized to signal the operator. This indicator may be the indicator 104 but preferably it is a different indicator 106 so the operator may immediately discern the problem.

Phase IV.

The actual refill or transfer of ink from off-board reservoir 20 to printhead cartridge reservoir 12 takes place during phase IV. Dispensing valve 24 is set to the position shown in FIG. 5A so that the dispensing line 46 communicates with ink line 64 through passage 71 and valve port 70. Control valve 22 was set to the position shown in FIG. 4C during phase III and is still in that position so as soon as valve 24 is set, the low pressure in lines 32 and 42 and in shell 34 forces ink from bladder 36 so that it flows through lines 44 and 64, valve 24 and line 46 to the cartridge reservoir 12.

As the ink flows from the bladder, the pressure in lines 32 and 42 and shell 34 gradually drops. The controller 100 periodically samples the pressure sensor 26 during phase IV and, when the sensor produces an indication that the pressure has dropped below the low pressure, the controller energizes pump motor 30 to bring the system back to the low pressure level. Referring to FIG. 2, the pump is energized when contact surface 90 moves below contact 92 and the energizing continues until the contact surface 90 has been moved counterclockwise to bridge between contact 92 and the lower edge of contact 94.

The refill operation continues for a fixed interval of time $T_5$ or until the level sensor 98 indicates to the controller 100 that the cartridge reservoir 12 is full.

The interval $T_5$ is the time it should take to refill an empty cartridge if the refill system is operating normally and there is no leakage or blockage of the ink flow path.

During the interval $T_5$ the controller 100 repetitively samples the level sensor 98 which should indicate rising levels of ink in cartridge reservoir 12 if ink is flowing from the off-board reservoir 20 into the cartridge reservoir. If the sampling of sensor 98 does not indicate a rising ink level in reservoir 12 and if the air displacement required to bring the system to the low pressure during Phase III exceeded a threshold value (indicating a low level of ink in reservoir 20) the controller sets indicator 106 to signal an operator that the off-board reservoir 20 is empty. In this case printing may be continued until the ink in cartridge reservoir 12 is exhausted. On the other hand, if the sampling of level sensor 98 does not indicate a rising ink level in reservoir 12 but the air displacement required to bring the system to the low pressure during Phase III did not exceed the threshold value (indicating an adequate level of ink in reservoir 20) indicator 104 is turned on to signal that operator intervention or a service call is required.

As previously stated, the pump 18 is intermittently actuated during Phase 4 to bring the system pressure back to the low level. During the entire Phase 4 the time between pump actuations and the time (or number of actuations) required to return the system to the low pressure level are closely monitored by controller 100. If pressure is lost too soon or if it takes too long to bring the system back to the low pressure level, the ink is flowing at an unusually high rate. This indicates a leak. Indicator 104 is actuated to signal that operator intervention is required, Phase IV is terminated and Phase V is initiated.

On the other hand, if the pressure drops too slowly the ink is flowing at too slow a rate. This indicates a blockage. Again, indicator 104 is actuated, Phase IV is terminated and Phase V is initiated.

Phase V.

Phase V is carried out after a successful refill operation or when the refill operation is aborted. During Phase V the system is depressurized and the lines are purged of ink. Control valve 22 is permitted to return to the position shown in FIG. 4D so that the pressure in reservoir 20 and line 42 is relieved by venting to the atmosphere through outlet 52. Valve 22 is then set to the position shown in FIG. 4B so that line 32 communicates with line 60 through passage 57. Pump 18 is energized for a fixed interval of time sufficient to drive ink in lines 60 and 64 through dispensing valve 24, fill tube 46 and into the cartridge reservoir 12. Pump 18 is then stopped and control valve 22 is returned to the position shown in FIG. 4A thereby relieving the pressure in lines 44, 46, 60 and 64 and valve 24. Finally, dispensing valve 24 is permitted to return to the position shown in FIG. 5B so that line 46 is open to the atmosphere through port 68 and ink in the fill tube drains into the cartridge reservoir.

A small volume of ink remains in line 44 until the next refill operation. This volume may be adjusted or selected by proper selection of the length and/or diameter of line 44. An adequate volume must exist such that the ink remains in a fluid state after air trapped in lines 60 and 64 becomes saturated with water vapor from the ink trapped in line 44. If the ink volume in line 44 is at least 1% of the air volume in lines 60 and 64, less than 1% of the water in the trapped ink will be lost as water vapor.

The invention may be adapted for use in color printers having three ink supplies 20 for refilling each of three printhead cartridge reservoirs 12 with inks of different colors. The cartridge reservoirs may be contained within a single cartridge or each reservoir may be in a different cartridge. If more than one printhead cartridge is used, the apparatus described above may be duplicated for each cartridge, or another multiport valve, similar to control valve 22, may be provided between the pressure detector 26 and the existing control valve 22, allowing use of a single pump and pressure detector for all cartridges.

If plural reservoirs are provided in a single cartridge, the control valve 22 must have an additional output for each reservoir and the dispensing valve 24 must have an additional output for each cartridge reservoir.

From the foregoing description it is evident that the ink supply system of the present invention provides many advantages over the prior art. Prior to each cartridge refill operation the system is checked for leaks using air rather than ink, thus reducing ink loss if there is a leak in the system. Because the system is tested at high pressure relative to its operating pressure, potential causes of ink leakage may be detected before actual ink loss occurs. In the event of a leak the source of the leak may be determined with air by turning the system on one or more times while examining lines, connections, etc. This avoids the necessity of repeating an earlier failing condition with its attendant loss of ink.

If electrical power is lost during a refill operation, the system automatically returns to the initial state. The bias on the handle of valve 22 returns the valve to the position shown in FIG. 4D so that the pressure in reservoir 20 and line 42 is relieved, and the bias on the handle of valve 24 returns this valve to the position shown in FIG. 5B so that dispensing line 46 is vented to the atmosphere to permit any ink therein to drain into cartridge reservoir 12.

Although some ink may be lost if an ink line should break or fall off while ink is being pumped, the pumping operation is aborted within a small fraction of a second, thereby reducing ink loss, and the system is returned to its initial state. The pumping operation is also aborted to reduce ink loss if the printhead cartridge 14 is removed during a refill operation.

Finally, the ink supply system monitors the presence of the off-board reservoir and the presence of an adequate supply of ink therein, and informs an operator when the reservoir requires attention.

We claim:

1. A refill system for intermittently refilling a cartridge reservoir of an ink jet printer with ink from an off-board ink supply via an ink flow path, the system including an air pump, an air flow path collecting said air pump to said ink flow path so that air may flow through said air flow path to the ink flow path to fill and pressurize the ink flow path with air prior to refilling the cartridge reservoir, and a pressure detector for detecting leakage of air from the ink flow path.

2. A refill system as claimed in claim 1 and further comprising a controller for actuating said air pump to pressurize and fill the ink flow path with air at a high pressure, said controller monitoring said pressure detector and terminating actuation of said air pump when said high pressure is reached.

3. A refill system as claimed in claim 2 wherein, after said high pressure is reached, said controller waits for an interval of time $T_2$ and then samples said pressure detector to determine if said high pressure has been maintained, said system including an indicator which is energized by said controller if said high pressure has not been maintained.

4. A refill system as claimed in claim 3 wherein said off-board ink supply comprises a flexible bladder containing ink, said bladder being disposed within an air-tight rigid shell, said system further comprising a control valve responsive to said controller for controlling flow of air from said air pump to said ink flow path and to a region between said bladder and said rigid shell.

5. A refill system as claimed in claim 4 wherein said controller, if it determines that said high pressure is still maintained at the end of said interval $T_2$, sets said control valve to vent said ink flow path and said region to atmosphere.

6. A refill system as claimed in claim 5 wherein, subsequent to the venting of said ink flow path and said region, said controller sets said control valve and actuates said pump to raise the pressure in said region from atmospheric pressure to a low pressure greater than atmospheric pressure but less than said high pressure, said pump being actuated for an interval of time $T_3$ or until the pressure in said region reaches said low pressure.

7. A refill system as claimed in claim 6 wherein, after the pressure in said region reaches said low pressure, said controller checks for leaks in said ink flow path after an interval of time $T_4$ by sensing said pressure detector to determine if the pressure in said ink flow path is still at said low pressure.

8. A refill system as claimed in claim 7 and further comprising a dispensing valve disposed in said ink flow path, said dispensing valve normally blocking the flow of ink through said ink flow path, said controller opening said dispensing valve to permit the flow of ink through said ink flow path to said cartridge reservoir if said low pressure is detected after'said interval of time $T_4$.

9. A refill system as claimed in claim 8 wherein, after said dispensing valve is opened, the pressure in said region slowly drops as ink flows into said cartridge reservoir, said controller monitoring the pressure in said region and intermittently actuating said pump to bring the pressure in said region back to said low pressure.

10. A refill system as claimed in claim 9 wherein, while said dispensing valve is open, said controller measures the time between pump actuations required to bring the pressure in said region back to said low pressure, compares the measured time to a reference time value, and aborts the refill operation if the measured time is less than, or exceeds, the reference time value.

11. A refill system as claimed in claim 9 wherein, while said dispensing valve is open, said controller counts the number of pump actuations required to bring the pressure in said region back to said low pressure, compares the counted number of pump actuations to a reference number, and aborts the refill operation if the counted number of pump actuations is less than, or exceeds, the reference number.

12. A refill system as claimed in claim 9 and further comprising an ink level sensor in the cartridge a reservoir, said controller monitoring said ink level sensor when ink is flowing into the cartridge reservoir and terminating actuation of said pump after an interval of time $T_5$ or when said ink level sensor senses that the cartridge reservoir is full.

13. A refill system as claimed in claim 12 wherein, after said ink level senses that the cartridge reservoir is full, said controller sets said control valve and actuates said pump so that air from said pump purges ink from said ink flow path.

14. A refill system as claimed in claim 13 wherein, after the ink has been purged from said ink flow path, the controller ceases actuation of said pump, the ink flow path is vented to the atmosphere through said control valve, and said dispensing valve is set to block the ink flow path.

15. A refill system as claimed in claim 6 wherein, as the pressure in said ink flow path is being raised from atmospheric pressure to said low pressure, the controller measures the air displacement and saves the measured air displacement as an indication of the volume of ink in the off-board ink supply.

16. A refill system as claimed in claim 15 wherein the controller measures air displacement by counting the number of strokes of said pump required to raise the pressure in said region from atmospheric pressure to said low pressure.

17. A refill system as claimed in claim 15 wherein the controller measures air displacement by measuring the interval of time it takes to raise the pressure in said region from atmospheric pressure to said low pressure.

18. A refill system as claimed in claim 15 and further comprising a dispensing valve in said ink flow path for blocking flow through the ink flow path, said dispensing valve being controlled to permit ink flow through the ink flow path to said cartridge reservoir after the pressure in said region has reached said low pressure, and an ink level sensor in said cartridge reservoir, said controller monitoring said ink level sensor to determine the level of ink in said cartridge reservoir, said controller energizing an indicator to signal an operator that the off-board ink supply is exhausted if the level of ink in the cartridge reservoir does not continuously rise while said dispensing valve is open and the measured air displacement exceeded a threshold level.

19. A refill system as claimed in claim 18 wherein said controller energizes a second indicator to signal that operator intervention is required if the level of ink in the cartridge reservoir does not continuously rise while said dispensing valve is open and the measured air displacement did not exceed a threshold level.

20. In a refill system for intermittently refilling a cartridge reservoir of an ink jet printer by transferring ink from an off-board ink supply via an ink flow path to said cartridge reservoir at an ink flow pressure, a method of checking for leaks in said ink flow path, said method comprising pressurizing the ink flow path to a test pressure prior to initiating a transfer of ink, said test pressure being on the order of at least twice said ink flow pressure, and, after an interval of time, determining if said ink flow path has maintained said pressure.

21. A method as claimed in claim 20 wherein air at said test pressure is introduced into said ink flow path to pressurize it.

22. A method as claimed in claim 20 wherein the ink flow path is pressurized at said test pressure with air before each transfer of ink to said cartridge reservoir, and the transfer of ink does not take place if it is determined that said ink flow path has not maintained said test pressure.

23. A refill system for intermittently refilling reservoir of an ink jet printer from an off-board ink supply, the system comprising:

an ink flow path connected to the ink supply for dispensing ink into the cartridge reservoir;

a pressure detector;

an air pump;

means including a pressure control valve for selectively connecting the ink flow path and the ink supply to the air pump;

a controller responsive to the pressure detector for controlling the pump and the pressure control valve to supply air at a test pressure from the pump, through said pressure control valve, to pressurize the ink flow path to check for leaks in the ink flow path, and supply air at an ink feed pressure from the pump, through said pressure control valve, to the ink supply to feed ink from the ink supply through the ink flow path to the cartridge reservoir.

24. A refill system as claimed in claim 23 wherein said ink supply comprises a flexible bladder containing ink and disposed within an air-tight rigid shell, air from said pump at the ink feed pressure being supplied to a region between said bladder and said shell.

25. A refill system as claimed in claim 23 and further comprising a dispensing valve disposed in said ink flow path, said dispensing valve being controlled by said controller to block said ink flow path while air at said test pressure is being supplied to said ink flow path.

26. A refill system as claimed in claim 25 wherein said dispensing valve is a multiple-state valve having a first state wherein a channel in the dispensing valve vents to the atmosphere a portion of the ink flow path extending between the dispensing valve and the cartridge reservoir, the dispensing valve being biased to said first state.

27. A refill system as claimed in claim 25 wherein said dispensing valve and said control valve are multiple-state valves each having two channels therein.

28. A refill system as claimed in claim 23 wherein said control valve is a multiple-state valve having a channel therein for venting said region to the atmosphere when the control valve is in a first state, said control valve being spring biased to said first state.

29. A refill system as claimed in claim 23 wherein said pressure detector comprises a rigid housing having an interior divided into first and second chambers by a flexible membrane, a movable electrical contact mounted at one end in cantilever fashion in said second chamber, said membrane being responsive to pressure changes in said first chamber to move said electrical contact, and a plurality of stationary contacts, said movable electrical contact wiping said stationary contacts as pressure changes in said first chamber.

30. A system as claimed in claim 23 wherein, provided there are no leaks or blockages in said ink flow path said controller is responsive to said pressure detector to intermittently actuate said air pump at a given frequency to maintain said ink feed pressure as said cartridge reservoir is being refilled, said controller determining when the frequency of actuation of said air pump is greater or less than said given frequency and controlling said air pump, said control valve and said dispensing valve to purge ink from said ink flow path and vent said ink flow path to atmosphere when said pump is actuated at less than, or greater than, said given frequency.

31. A refill system for intermittently refilling a cartridge reservoir of an ink jet printer from an off-board ink supply via an ink flow path, said system comprising an air pump, a control valve having a first position for connecting said ink flow path to said air pump and a second position connecting said ink flow path to atmosphere, a dispensing valve in said ink flow path, said dispensing valve having a first position permitting a flow of ink through said ink flow path and a second position blocking said ink flow path and a controller controlling said air pump, said control valve and said dispensing valve to automatically purge ink from said ink flow path and vent said ink flow path to the atmosphere after a refill operation is completed, said controller setting said dispensing valve and control valve to their first positions and energizing said air pump so that ink is purged from said ink flow path, said controller then setting said control valve to its second position to vent said ink flow path to atmosphere.

* * * * *